US008161575B2

(12) United States Patent
Debrick

(10) Patent No.: US 8,161,575 B2
(45) Date of Patent: Apr. 24, 2012

(54) ADJUSTABLE WINTER GARMENT

(76) Inventor: E. Patricia Debrick, Washington, DC (US)

( * ) Notice: Subject to any disclaimer, the term of this patent is extended or adjusted under 35 U.S.C. 154(b) by 1341 days.

(21) Appl. No.: 11/126,292

(22) Filed: May 11, 2005

(65) Prior Publication Data

US 2006/0253958 A1 Nov. 16, 2006

(51) Int. Cl.
*A42B 5/00* (2006.01)

(52) U.S. Cl. ..... 2/207; 2/206

(58) Field of Classification Search ..... 2/206, 207, 2/208, 209, 202, 203, 468, 174, 91, 92
See application file for complete search history.

(56) References Cited

U.S. PATENT DOCUMENTS

| | | | | | |
|---|---|---|---|---|---|
| 856,720 | A | * | 6/1907 | Neuman | 2/91 |
| 866,752 | A | * | 9/1907 | Way | 2/91 |
| 905,270 | A | * | 12/1908 | Abraham | 2/91 |
| 946,770 | A | * | 1/1910 | Sands | 2/68 |
| 2,448,021 | A | * | 8/1948 | De Grazia | 2/205 |
| 2,686,317 | A | * | 8/1954 | Michaelis | 2/205 |
| 2,735,283 | A | * | 2/1956 | Schuessler | 2/202 |
| 2,839,757 | A | * | 6/1958 | Gianola | 2/205 |
| 3,469,264 | A | * | 9/1969 | Harris | 2/46 |
| 4,495,660 | A | * | 1/1985 | Hayden | 2/91 |
| 4,771,479 | A | * | 9/1988 | Silver | 2/85 |
| 4,980,928 | A | * | 1/1991 | Ellis | 2/88 |
| 5,016,287 | A | * | 5/1991 | Harris | 2/202 |
| 5,091,996 | A | * | 3/1992 | Kirby | 2/206 |
| 5,109,549 | A | * | 5/1992 | Mattinson | 2/202 |
| 5,115,516 | A | * | 5/1992 | Golde | 2/108 |
| 5,115,517 | A | * | 5/1992 | Ferguson et al. | 2/203 |
| 5,153,943 | A | * | 10/1992 | Clement | 2/418 |
| 5,212,837 | A | * | 5/1993 | Gose et al. | 2/172 |
| 5,214,804 | A | * | 6/1993 | Carey et al. | 2/206 |
| 5,251,336 | A | * | 10/1993 | Nevins | 2/202 |
| 5,293,646 | A | * | 3/1994 | Winston | 2/88 |
| 5,493,734 | A | * | 2/1996 | Nieves-Rivera | 2/209.13 |
| 5,694,648 | A | * | 12/1997 | Nucifora | 2/172 |
| 5,704,068 | A | * | 1/1998 | Martin | 2/173 |
| 5,790,986 | A | * | 8/1998 | Hall | 2/172 |
| 5,802,618 | A | * | 9/1998 | Mustata | 2/207 |
| 5,822,800 | A | * | 10/1998 | Anderson | 2/202 |
| 5,832,538 | A | * | 11/1998 | Williams | 2/202 |
| D406,936 | S | * | 3/1999 | Sivret et al. | D2/881 |
| 5,960,478 | A | * | 10/1999 | Sivret et al. | 2/202 |
| 6,006,360 | A | * | 12/1999 | Reed | 2/202 |
| 6,023,787 | A | * | 2/2000 | French et al. | 2/202 |
| 6,029,278 | A | * | 2/2000 | Lopez | 2/209.13 |
| 6,052,830 | A | * | 4/2000 | Payne | 2/171.1 |
| 6,226,799 | B1 | * | 5/2001 | Lane | 2/207 |
| 6,260,206 | B1 | * | 7/2001 | MacDonald et al. | 2/181 |
| 6,260,207 | B1 | * | 7/2001 | Barbeau et al. | 2/202 |
| 6,425,138 | B1 | * | 7/2002 | Johnson | 2/202 |

(Continued)

*Primary Examiner* — Alissa L Hoey
(74) *Attorney, Agent, or Firm* — Browdy and Neimark, PLLC

(57) ABSTRACT

An adjustable winter garment made of supple material wraps around the face, covering the wearer from the temples and just below the eyes to the chest. The winter garment can be adjusted and worn in any of five positions, by either adjusting the fasteners or the drawstring. By adjusting the fasteners the garment can be worn in a first position reaching from the chest to under the eyes. A second position reaches to under the nose, while a third position obtained by adjusting the fasteners wraps around the chin. Finally, the garment may be unfastened to lay open upon the chest like a shirt. By adjusting the drawstring, the garment may be worn covering the lower face, like a scrunch neck collar or folded down and rolled over like turtleneck, covering only the neck and chest.

7 Claims, 12 Drawing Sheets

U.S. PATENT DOCUMENTS 6,665,881 B2 * 12/2003 Giggleman et al. ..... 2/202
6,789,266 B1 * 9/2004 Mills et al. ..... 2/172
7,003,801 B2 * 2/2006 Grilliot et al. ..... 2/5
D518,625 S * 4/2006 Barnhouse ..... D2/866
7,096,511 B2 * 8/2006 Cohen ..... 2/206
7,137,150 B2 * 11/2006 Larson ..... 2/202
7,152,252 B2 * 12/2006 Gellis et al. ..... 2/206
7,290,293 B2 * 11/2007 Kanitz ..... 2/207
2003/0126672 A1 * 7/2003 Giggleman et al. ..... 2/202
2006/0085881 A1 * 4/2006 Gellis et al. ..... 2/9
2006/0143796 A1 * 7/2006 Bugarin ..... 2/202
2006/0143797 A1 * 7/2006 Waldman ..... 2/202
2007/0204384 A1 * 9/2007 Carey ..... 2/207
2008/0216211 A1 * 9/2008 Dolby ..... 2/206

* cited by examiner

ADJUSTABLE WINTER GARMENT

FIELD

The present invention relates generally to face, neck and chest coverings that provide warmth and protection from cold weather elements.

BACKGROUND

There is a need to a keep the wind and cold off the face ears, chest areas during the winter months. There are a number of garments commercially available, which cover and fit around a person's temples, face, nose, ears and chest to provide warmth, prevent reddened and chapped skin, and warm, humidify and filter air. Such garments are often used for outdoor work or leisure activity in winter weather. One of the most ubiquitous of such garments is the traditional scarf or muffler, consisting of a generally rectangular piece of warm material. While the traditional scarf is flexible in how it can be worn, such as over the head, around the face and/or neck, or over the chest and neck, the traditional scarf is prone to loosening around the wearer. In particular, when worn around the face, a traditional scarf often falls lower on the face or allows significant gaps between the scarf and the wearer so that cold air reaches the wearer. This minimizes the effectiveness of the scarf in providing warmth.

Furthermore, traditional scarves are difficult to arrange so as to cover the wearer from the temple to the chest without increasing the risk of the scarf gapping and falling down or failing to provide adequate warmth. In addition, a traditional scarf covers the top of the wearer's head and hair when arranged so as to cover the wearer's temples, causing damage to the wearer's hairstyle. Thus there is a need for a face, neck and chest covering that does not fall down or gap and provides warmth and coverage from the chest to just below and around the eyes, including the temples and the ears without damaging the wearer's hairstyle.

The F811 Polar Balaclava & Neck Warmers pattern from The Green Pepper, Inc. shows a long neck warmer that covers the neck, chest and back with its fleece material shaped so that the bottom of the garment splits over the wearer's shoulders. The long neck warmer is one piece, fastened in the back. The neck warmer does not cover the wearer's ears, nose or temples. Nor is the neck warmer designed to be adjustable. Furthermore, the neck warmer is not contoured to fit the wearer's face, allowing gaps between the neck warmer and the person wearing the neck warmer.

Another common problem with the prior art winter garments is resistance to wearing unattractive winter masks in public. Scarves or masks are recommended by doctors for people with lung or heart disorders when the temperature drops below 35 degrees. Asthmatic children often are not able to play outside in winter and have difficulty walking to school for lack of a convenient, effective, attractive means of raising the temperature of cold air so that it is comfortable and safe to breathe. The outside activity of elderly and asthmatic adults is frequently restricted in cold climates for the same reason. People whose work requires that they be outside in cold weather, for example, telephone and electrical repair people, and people who exercise, also suffer from inhaling cold air. Resistance to the use of unwieldy or unbecoming masks in public endangers people with lung disorders and restricts outdoor ventures by people who need protection. A convenient, comfortable, secure, fashionable, durable, washable mask is needed to replace traditional scarves and cumbersome or unsightly alternatives.

Patented inventions attempting to address the problem of the effect of cold air on respiration are unwieldy, impractical, often interfere with wearing eyeglasses, and/or are unattractive. Cold weather masks such as O'Brien U.S. Pat. No. 4,095,290 and Edwards U.S. Pat. Nos. 4,300,240, 4,825,474 and 5,214,804 (with Carey) may warm the face, but leave the nostrils uncovered to inhale cold air. Three other masks, Ward U.S. Pat. No. 4,458,679, Tiger U.S. Pat. No. 4,150,671 (for cardiac patients), and Colman U.S. Pat. No. 3,768,100, are equally inconvenient for ordinary people with sensitive lungs when they go in and out of buildings and vehicles, take walks on cold days, or are around animals.

SUMMARY

An adjustable winter garment made of supple material wraps around the face, covering the wearer from the temples and just below the eyes down to the chest. The garment can be adjusted and worn in any of five positions, by either adjusting the fasteners or the drawstring. By adjusting the fasteners, the garment can be worn in a first position reaching from the chest to under the eyes. A second position reaches to under the nose, while a third position obtained by adjusting the fasteners wraps around the chin. The garment may also be unfastened to lay open upon the chest like a shirt. By adjusting the drawstring, the garment may be worn covering the lower face, like a scrunch neck collar or folded down and rolled over like turtleneck, thus covering the neck and chest.

DETAILED DESCRIPTION

The garment described herein wraps around the face and is adjustable to five different positions. The position of maximum coverage reaches from the chest to just below the eyes and up to cover the wearer's temples. When not needed to cover the face, the garment is designed to be worn lowered, beneath the chin, to lay open, or to roll into a turtleneck. The snugness and the user's ability to adjust the fit of the garment provide advantages over currently available garments. The continuously variable fasteners allow the user to customize the fit to prevent slippage or gapping. The garment is designed to have the same flexibility as the traditional rectangular scarf, while providing better coverage for the ears, face, temples and the chest.

As can be seen in FIGS. 1-9, a device according to a first embodiment of the present invention comprises a garment 1 that wraps around the face, neck and upper torso and can be worn in at least five different positions. The garment 1 may be manufactured from any soft, supple material of suitable warmth, preferably fleece, silk, wool, cashmere, suede, leather, or the like, and combinations thereof. In addition, the garment may be manufactured seamlessly, such as by knitting. Preferably, the garment is manufactured from washable material for ease of maintenance. The garment may be lined for softness, beauty or additional warmth. A preferable embodiment is made from fleece with an inner silk lining.

Figure 1:
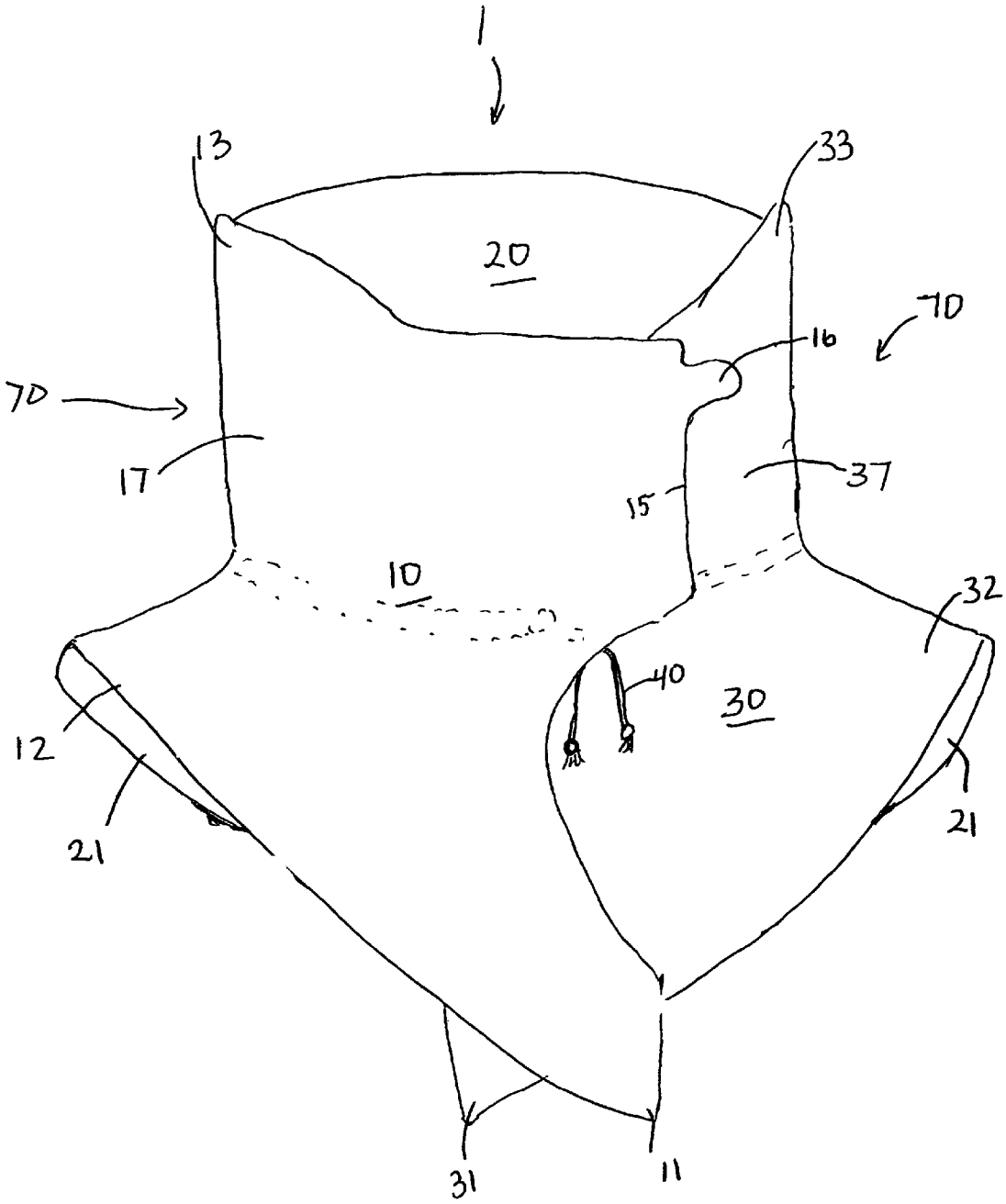
FIG. 1: Shows a perspective of a first embodiment of the invention.

FIG. 1 shows a perspective view of the closed garment 1 laid flat. The garment 1 comprises a right front side piece 10 attached to the right side 23 of a back piece 20 and a left front side piece 30 attached to the left side 24 of the back piece 20. As used to refer to garment pieces, left and right designations shall be made as if from a wearer's perspective herein. A drawstring 40 is inserted at the bottom of the neck portion 70 of garment 1. The entire garment when laid out may be from approximately 33 inches to approximately 17 inches wide, from right collar edge 15 to left collar edge 35. The garment may be made from approximately 18 inches to approximately 12 inches long, from the high temple covering members 13, 33 to the distal most portion of the tapered front tail members 11, 31 when laid out to its full extent. Those skilled in the art will recognize that the garment 1 may be made in various sizes to fit both children and adults of different stature.

Figure 2:
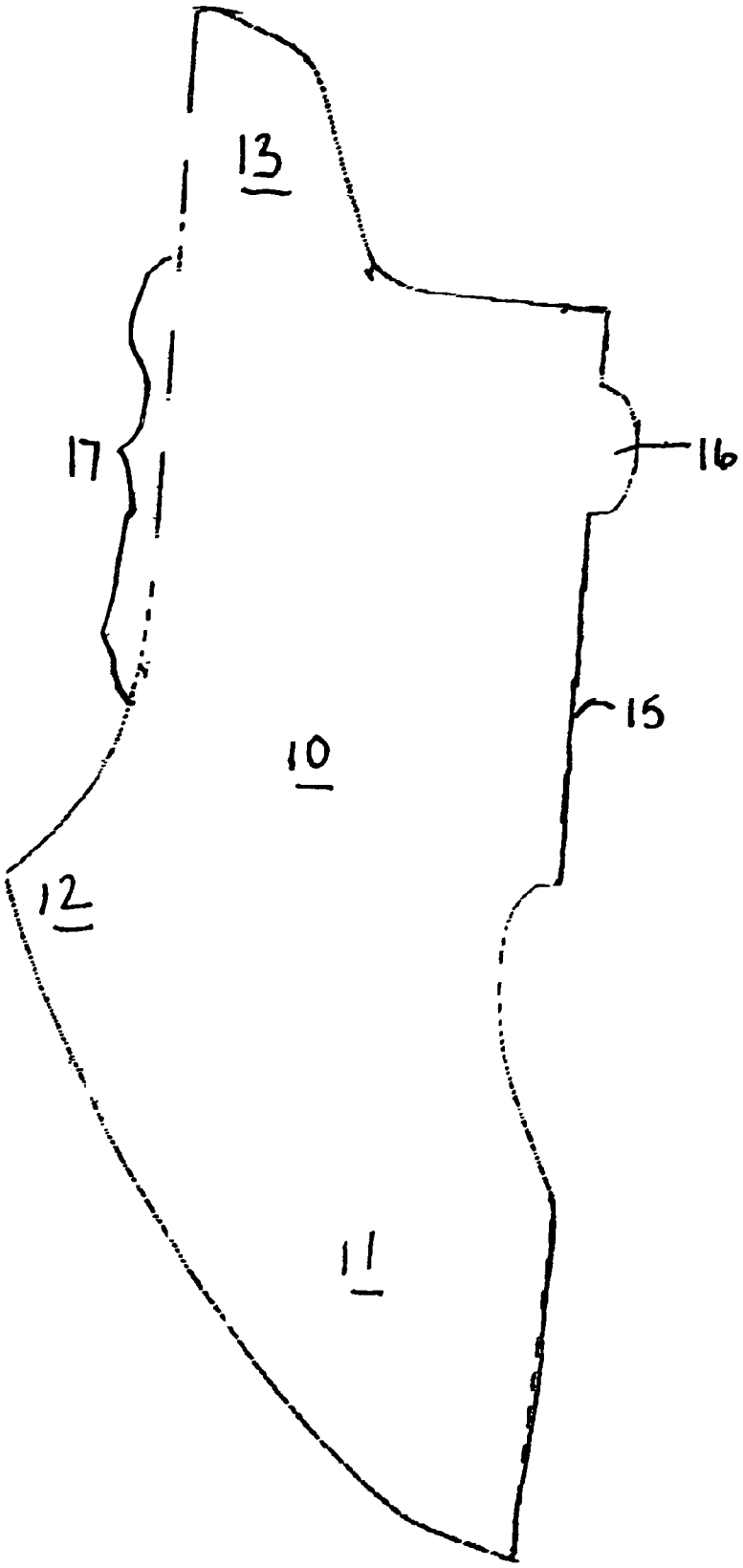
FIG. 2: Shows the right front side piece of a first embodiment of the invention.

FIG. 2 shows the right front side piece 10 before it is assembled into the garment 1. The right front side piece 10 comprises a right tapered front tail member 11 for covering the chest, a right wide shoulder member 12 flaring to the right from the top of the right tapered front tail member 11 and suitable for fitting under an outer garment and to hold the garment 1 in place when not fastened, a right front neck portion 17 extending above the right wide shoulder member 12, a right high temple covering member 13 extending from the upper right of the right front neck portion 17 to protect the right temple and ear, and a right collar edge 15 with a protrusion 16 and continuously variable fasteners, such as hook and loop tape or the like, not shown, to attach to the front of the left front side piece 30 when worn in a closed position. The right front side piece 10 is also provided with an inner casing disposed along the junction of the right wide shoulder member 12 and the bottom of the right front neck portion 17 for holding the drawstring 40.

The continuously variable fasteners enable the user to customize the fit by continuously varying the circumference of the fastened garment. Thus, the garment will fit closely around any desired portion of the user's head or neck. In addition to the continuously variable fastener, the inside of the right front piece 10 is provided with a casing for holding the drawstring 40 and an opening inside and near the right collar edge 15 through which the end of the drawstring 40 protrudes. The drawstring 40 is a type of continuously variable fastener that allows the users to conveniently gather the material of the garment 1 closer to the body. The protrusion 16 acts to aid the wearer in aligning the left front side with the right front side and securely fastening them together by acting as a guide and a pull tab for adjusting the continuously variable fasteners.

Figure 3:
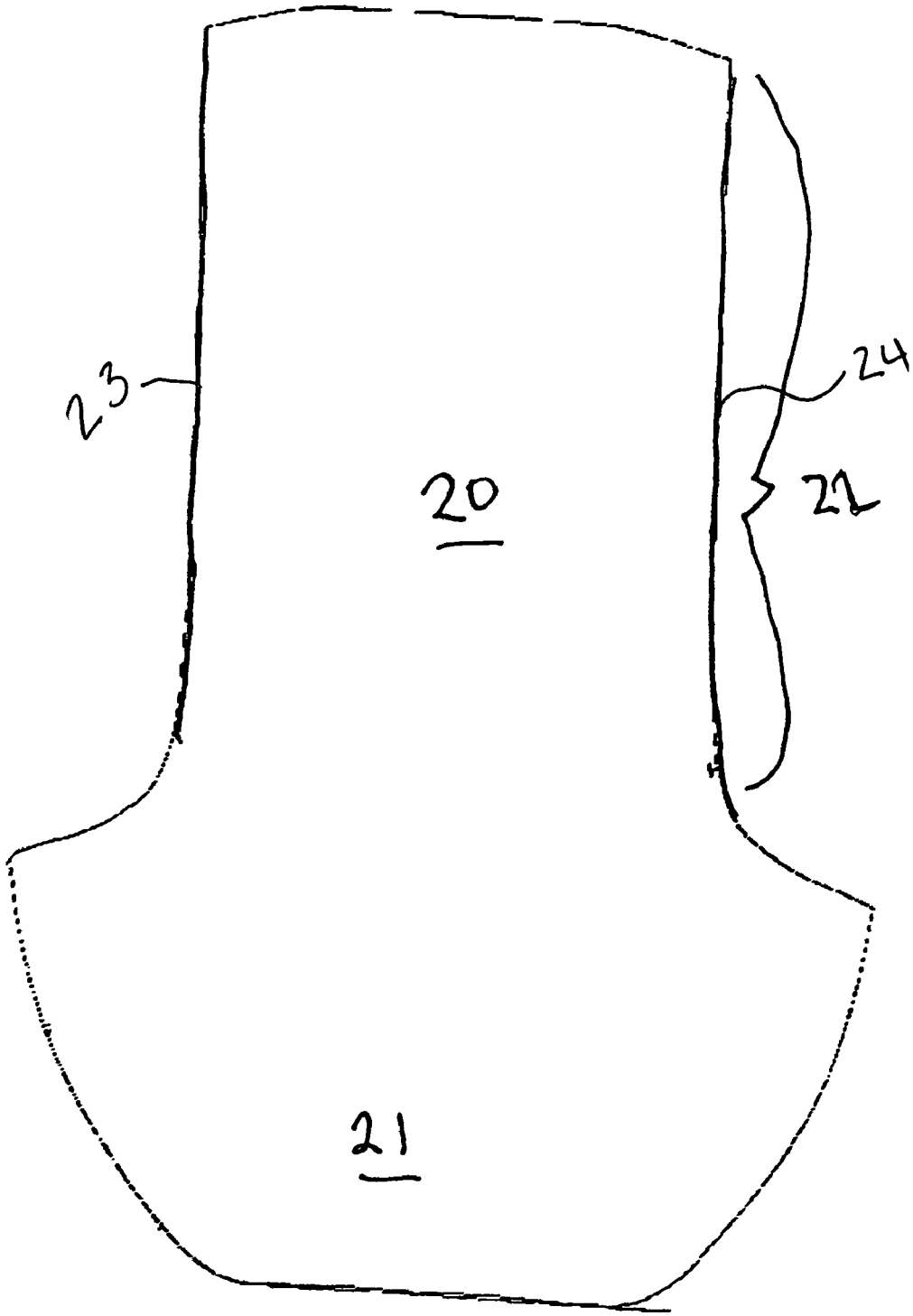
FIG. 3: Shows the back piece of a first embodiment of the invention.

FIG. 3 shows the back piece 20 before it is assembled into the garment 1. The back piece 20 comprises a long, curved back member 21 to protect the upper back and an upper neck portion 22 shaped to fit between the right front side piece 10 and the left front side piece 30 and protect the back of the neck and head when assembled. The back upper neck portion 22 has a right side 23 for attaching to the right front side piece 10 and a left side 24 for attaching to the left front side piece 30. The casing holding the drawstring 40 is not shown, but is provided along the lower edge of the upper neck portion 22 above the curved back member 21.

Figure 4:
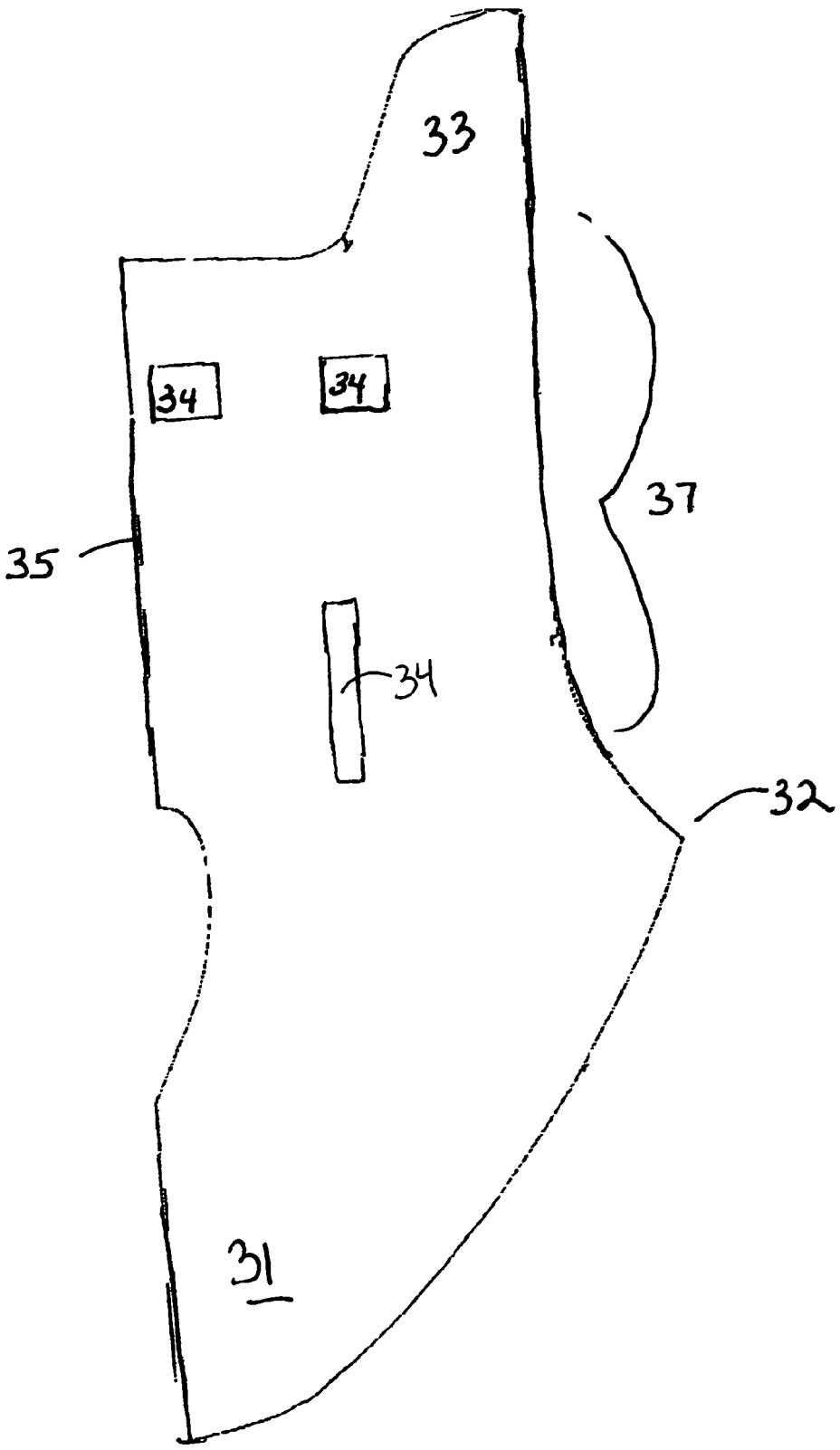
FIG. 4: Shows the left front side piece of a first embodiment of the invention.

FIG. 4 shows the left front side piece 30 before it is assembled into the garment 1. The left front side piece 30 comprises a left tapered front tail member 31 for covering the chest, a left wide shoulder member 32 flaring to the left from the top of the left tapered front tail member 31 to fit under an outer garment and hold the garment 1 in place when not fastened, a left front neck portion 37 extending above the left wide shoulder member 32, a left high temple covering member 33 to protect the left temple and ear, and a left collar edge 35 with continuously variable fasteners 34, such as hook and loop tape, to attach to the back of right front side piece 10 when worn. As is clear to one skilled in the art, the fastening arrangement may be reversed to fasten the left front side piece 30 over the right front side piece 10 if desired.

Figure 5:
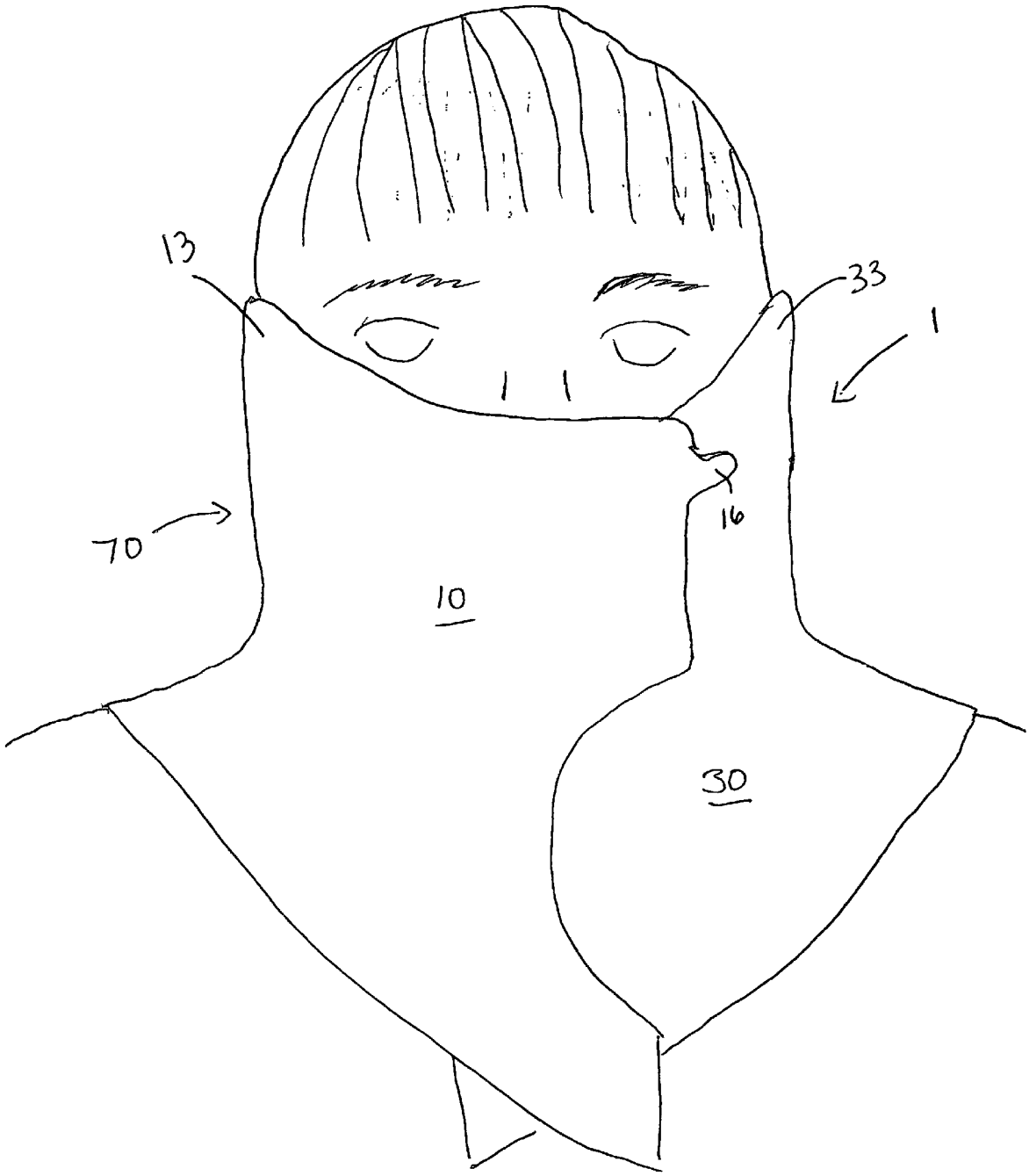
FIG. 5: Shows a wearer using a first embodiment of the invention in position one.

FIG. 5 shows the garment 1 worn in the position of maximum coverage that reaches from the chest to just below the eyes and up to cover the wearer's temples and ears. The garment 1 is adjusted to fit in this position by the user, who first places the open garment around his or her shoulders and neck, with the wide shoulder members 12, 31 holding the garment loosely in place. Then the user smoothes the left front neck portion 37 across his or her face and over his or her nose, just below his or her eyes. With his or her right hand, the user holds the protrusion 16 between thumb and forefinger and pulls the right front neck portion 17 over the left front neck portion 37 snugly and fastens the continuously variable fasteners 34. The drawstring 40, may then be adjusted as needed to minimize any gaps between the garment and the user's neck.

Figure 6:
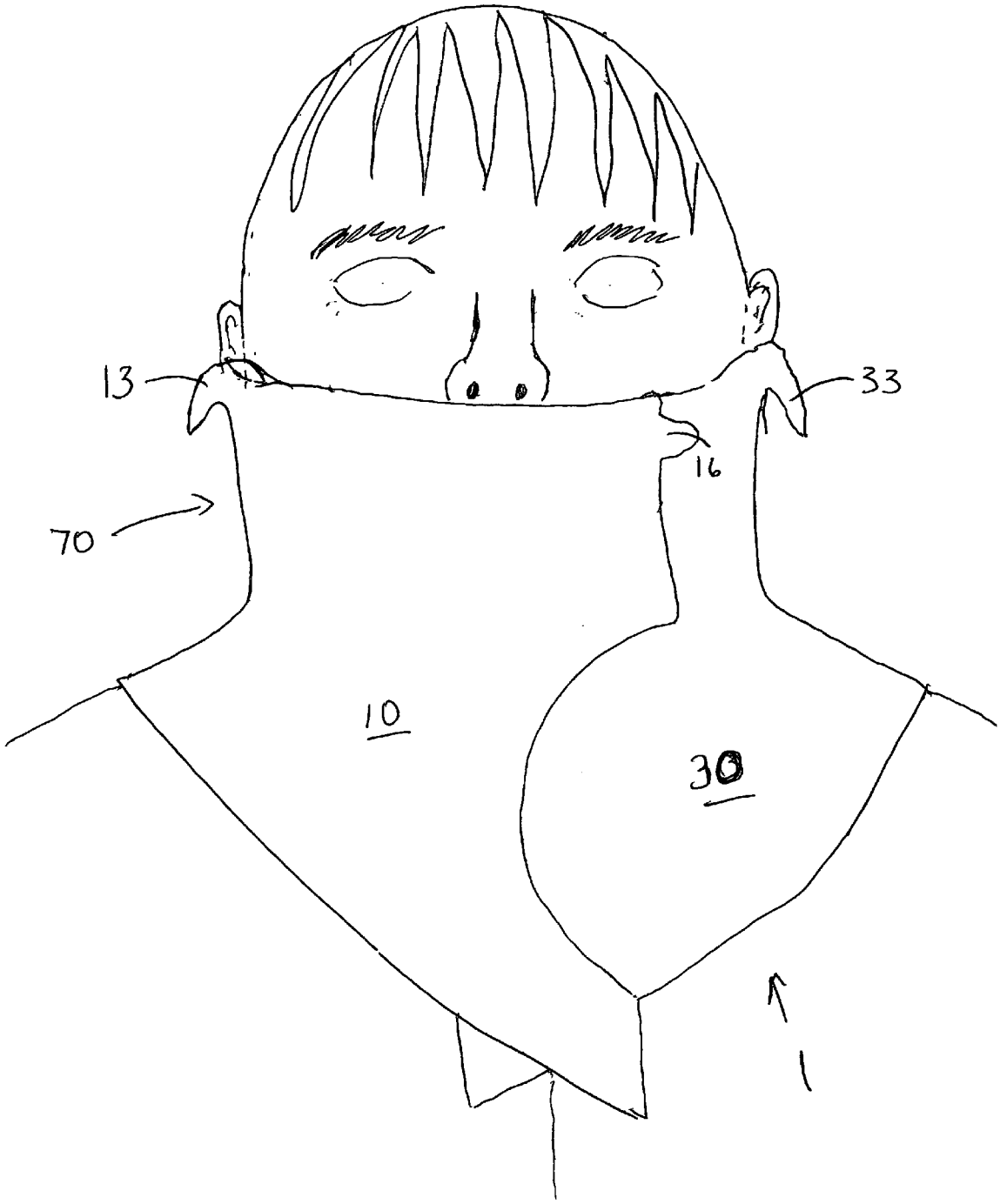
FIG. 6: Shows a wearer using a first embodiment of the invention in position two.

FIG. 6 shows the garment 1 worn in a second position that reaches from the chest to under the nose. The user adjusts the garment 1 to fit in the second position in a similar manner. However, to adjust the garment in the second position the front neck portions 17, 37 are smoothed just under the nose. The high temple covering members 13, 33 may be folded down and out as shown in FIG. 6, worn up to cover the tops of the user's ears, or folded down and inside of the garment for a smooth, clean look.

Figure 7:
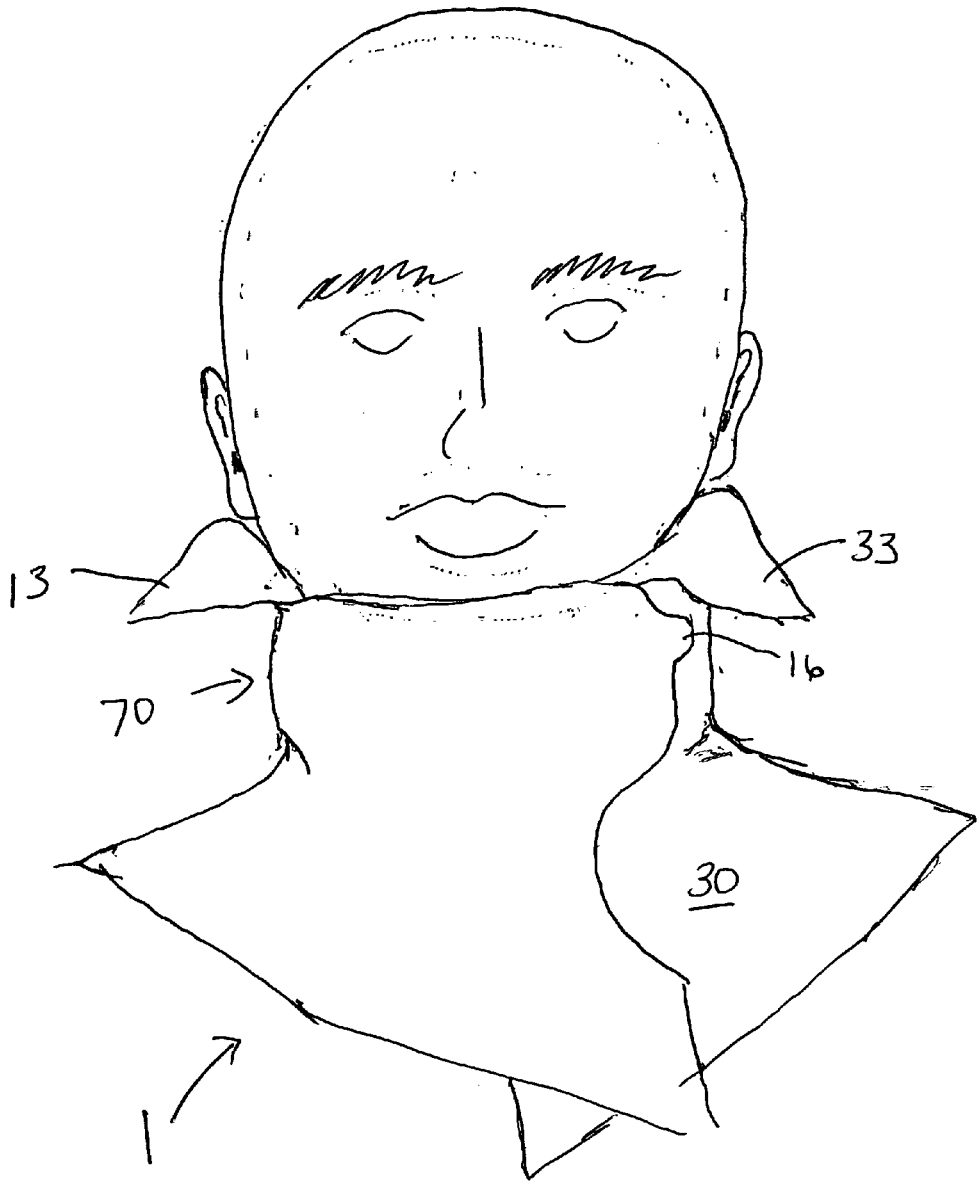
FIG. 7: Shows a wearer using a first embodiment of the invention in position three.

FIG. 7 shows garment 1 worn in a third position obtained by adjusting the fasteners so that the garment 1 wraps around the lower chin. Similarly to the first and second positions, the left front neck portion 3 is smoothed across the chin, while the protrusion 16 is pulled tight around the user's chin so that the garment 1 securely wraps around the lower chin. Also like the second position, the high temple covering members 13, 33 may be folded down as shown in the figure or worn up to cover the user's ears.

Figure 8:
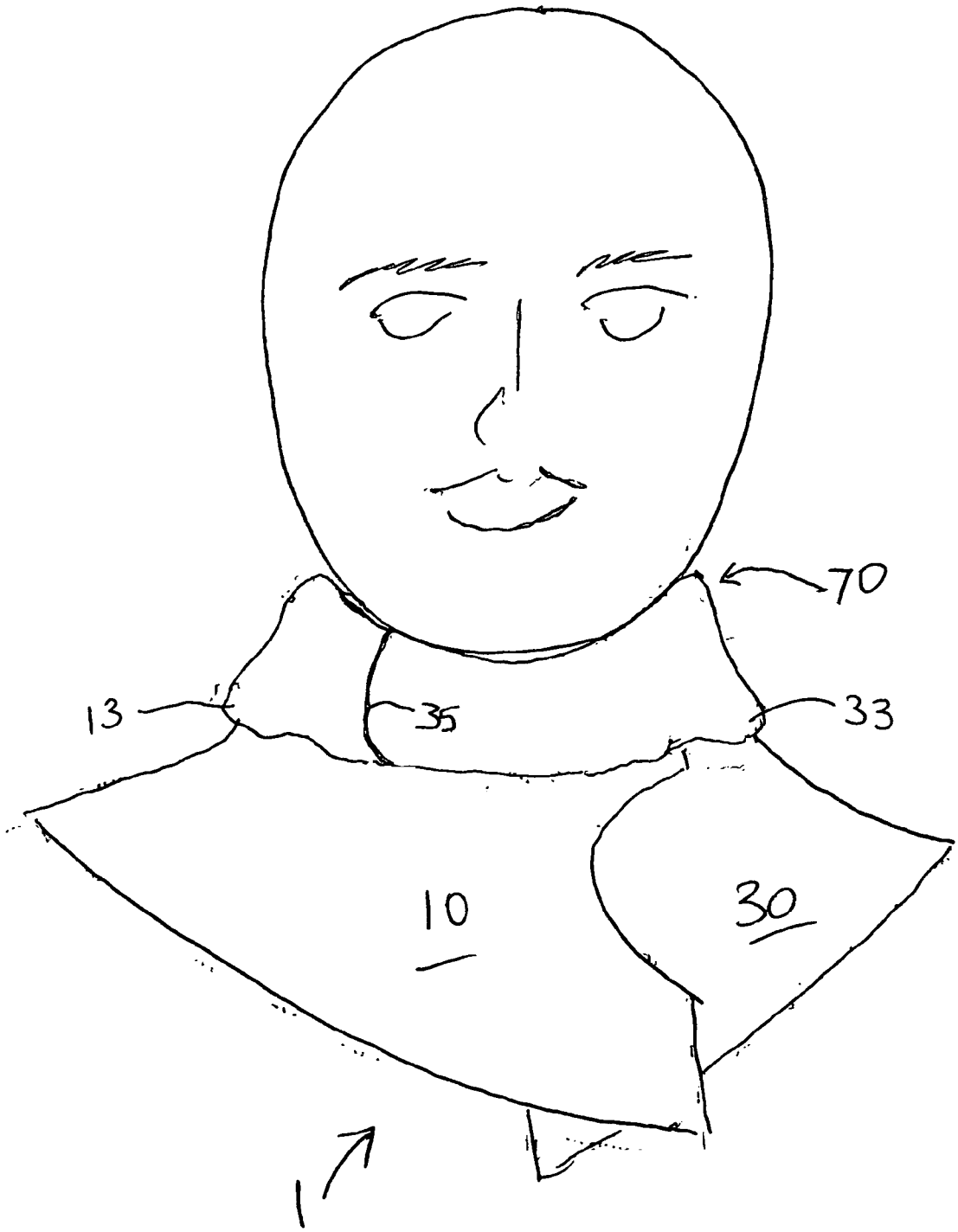
FIG. 8: Shows a wearer using a first embodiment of the invention in position four.

FIG. 8 shows garment 1 worn in a fourth position achieved by adjusting the drawstring. The fourth position of the garment 1 extends only up to the chin, like a scrunch neck collar or turtleneck, covering only the neck and chest. The left front neck portion 17 is fastened loosely to the right front neck portion 37 and folded or scrunched down below the chin. The drawstring 40 is adjusted to minimize the bulk around the neck.

Figure 9:
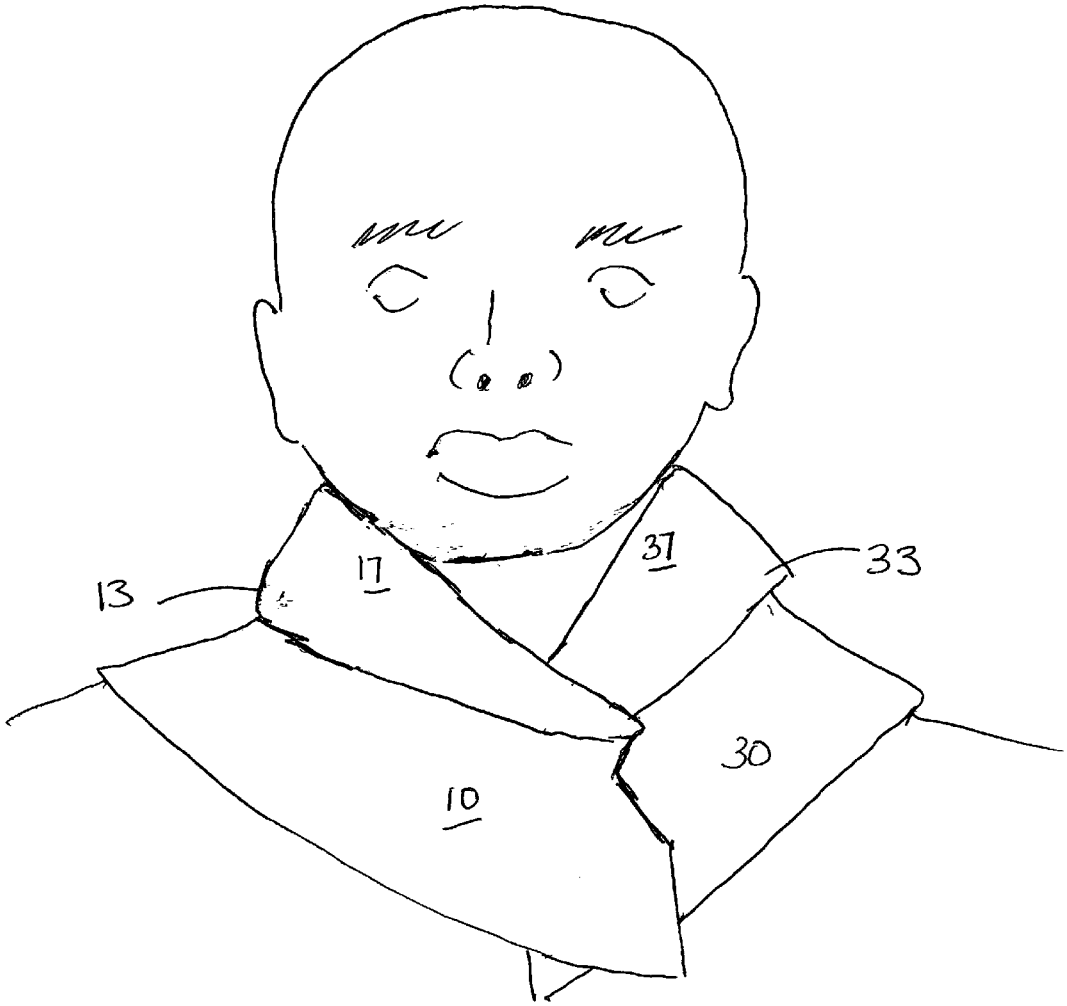
FIG. 9: Shows a wearer using a first embodiment of the invention in position five.

FIG. 9 shows the garment 1 unfastened to lay open upon the chest like a shirt, while still covering the wearer's neck and chest and giving protection to the neck similar to a traditional rectangular scarf. The front neck portions 17, 37 are folded with the high temple covering members 13, 33 are turned down at the shoulder to form the lapel and collar of the garment 1 in this fifth position.

Figure 10:
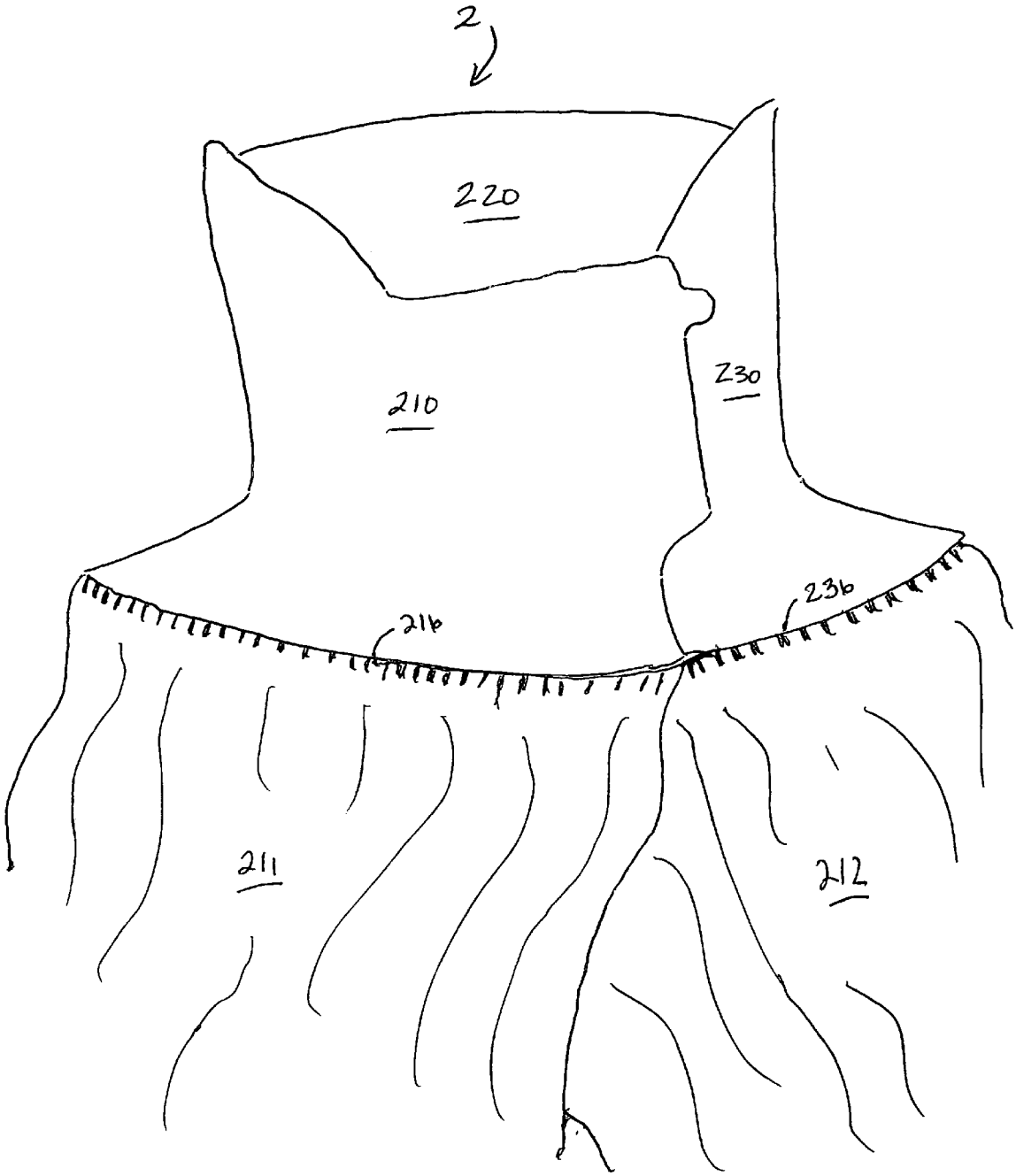
FIG. 10: Shows a second embodiment of the invention.

FIG. 10 shows a second embodiment comprising a garment 2 that wraps around the face and neck. The garment 2 comprises a left front side piece 210 attached to the left side of a back piece 220 and a right front side piece 230 attached to the right side of the back piece 220. Attached to the lower edge of the garment are a plurality of loosely draped light scarf portions made from soft material, such as silk chiffon or the like. FIG. 10 shows a front left scarf portion 211 gathered at a top edge where it is attached to the lower edge 216 of the left front side piece 210. A front right scarf portion 212 is also gathered at a top edge where it is attached to the lower edge 236 of the right front side piece 230 of the garment 2. The scarf portions may be draped or tied across the user's upper chest according to the user's preferences. The scarf portions allow the garment 2 to be styled in a more feminine fashion and for further flexibility in the manner in which the garment is arranged below the neck.

Figure 11:
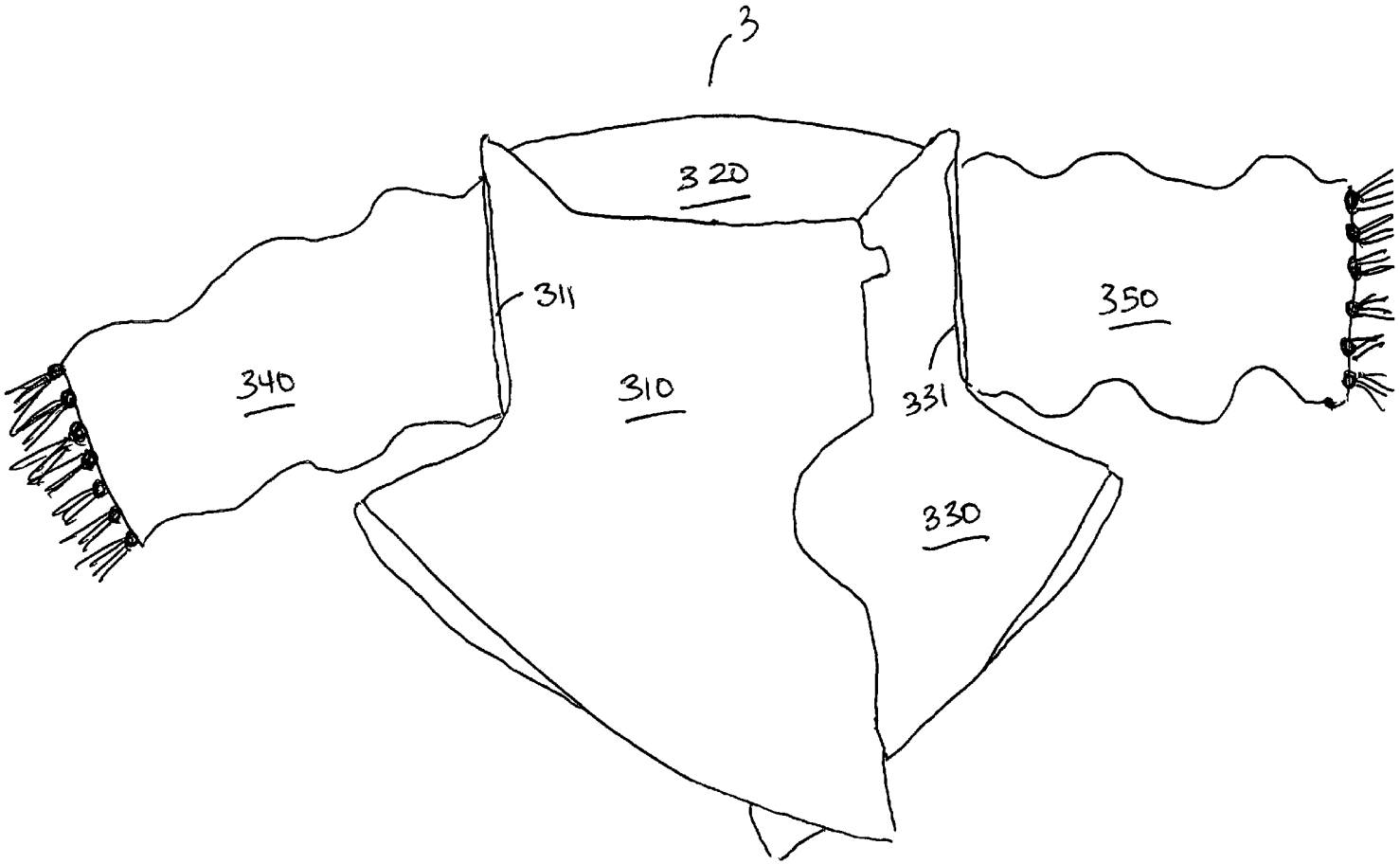
FIG. 11: Shows a third embodiment of the invention.

FIG. 11 shows a third embodiment comprising a garment 3 that covers the head and wraps around the face, neck and upper torso. The garment 3 comprises a left front side piece 310 attached to the left side of a back piece 320, a left scarf piece 340 attached to the seam 311 between the left front side piece and the back piece, a right front side piece 330 attached to the right side of the back piece 320, and a right scarf piece 350 attached to the seam 331 between the right front side piece and the back piece. The left and right scarf pieces allow the garment 3 to be styled similarly to a traditional rectangular scarf without sacrificing any of the warmth, security and coverage of the present invention. In addition, if desired, the seams 311 and 331 may be provided with slits providing access to a channel in the back piece 320, so that the user may attach any desired traditional rectangular scarf to the garment. This allows for further adjustments to the style of the garment as well as a means to secure the scarf so it is not lost.

Figure 12:
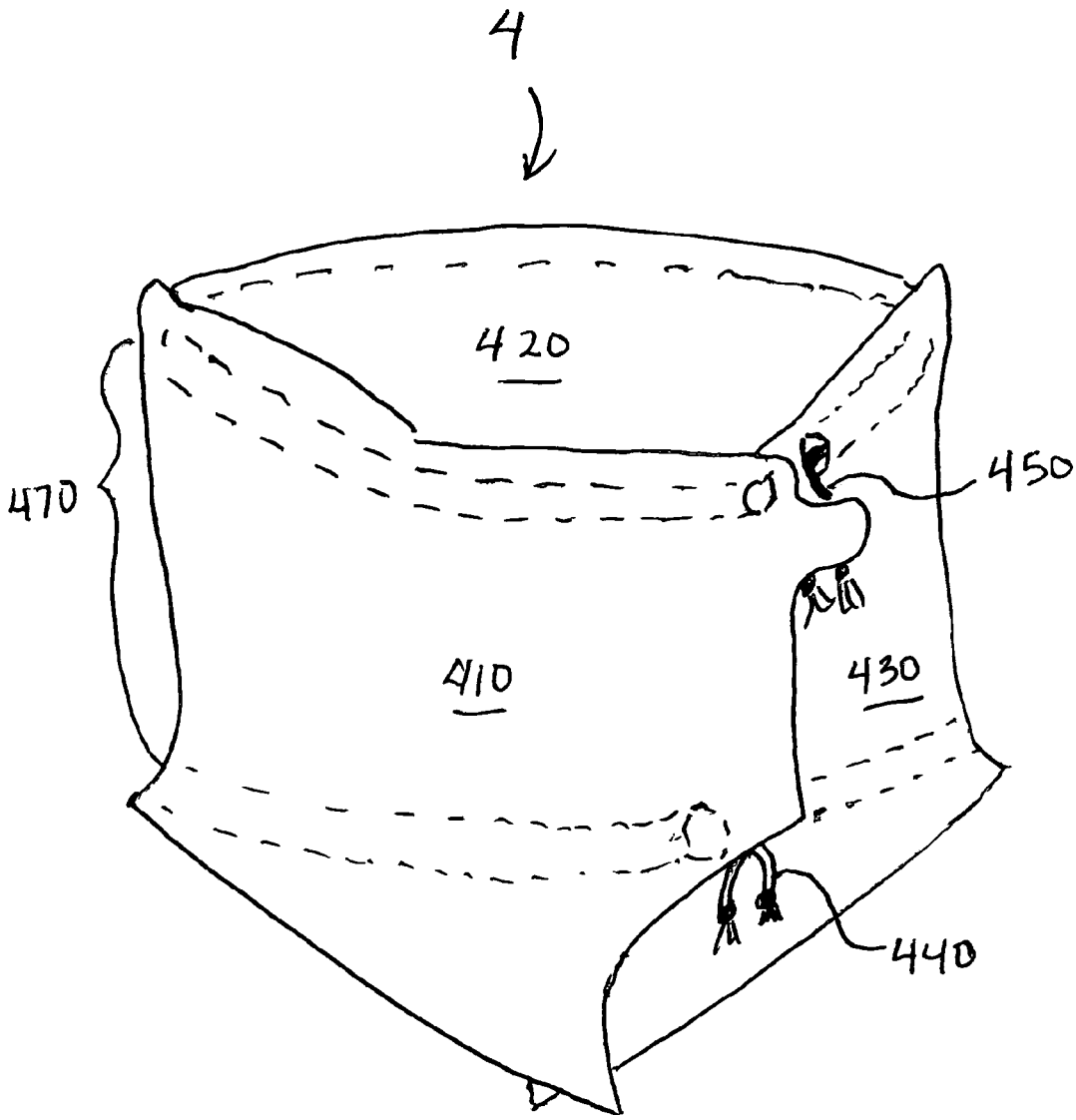
FIG. 12: Shows a fourth embodiment of the invention.

FIG. 12 shows a fourth embodiment comprising a garment 4 that covers the head and wraps around the face and neck. Garment 4 does not provide coverage to the chest and thus is more appropriate for skiers and others engaged in more strenuous outdoor activities. The garment 4 comprises a left front side piece 410 attached to the left side of a back piece 420, a right front side piece 430 attached to the right side of the back piece 420. Each front side piece is provided with a central, roughly rectangular front neck portion, a high temple covering member extending from an upper corner front neck portion to protect the temple and ear, and a collar edge with continuously variable fasteners, such as hook and loop tape or the like, not shown, to attach to the other front side piece when worn in a closed position. The garment 4 is also provided with an inner casing disposed along the bottom of the right front neck portion for holding the drawstring 440. A lower drawstring 440 is inserted at the bottom of the neck portion 470 of garment 4. A second inner casing and an upper drawstring 450 is inserted at the top edge of the garment 4 providing additional protection from cold air, wind or particulates entering from the top of the garment 4. The garment 4 is not provided with shoulder members, as coverage stops at the bottom of the neck, proximate the collar bone. The tail members of the front side pieces come to rest proximate the collar bone when worn as preferred. As an option, the upper drawstring may also be provided with any other embodiment described herein.

In another embodiment, a hood may be attached to the back piece. The back piece may be provided with a stow-away pocket to store the hood when not in use. The hood may also be provided with a brim or sun visor to cut down on glare, such as may be reflected from the snow.

The embodiments described above are for purposes of illustration only and the various modifications of these embodiments are considered to be within the scope of the teachings and advantages of this invention, which is to be limited only by the claims appended hereto.

What is claimed is:

1. A stand-alone adjustable winter garment, consisting of:

a right front side piece having a top edge that forms a top terminal edge of the right front side piece and a bottom edge that forms a bottom terminal edge of the right front side piece, the right front side piece being configured to extend from slightly below a breastbone to cover a temple of a wearer when worn in a fully extended position and having left and right edges;

a back piece and having a top edge that forms a top terminal edge of the back piece and a bottom edge that forms a bottom terminal edge of the back piece, the back piece being configured to extend from slightly above a pair of shoulder blades to a midpoint of a head of the wearer, wherein the left edge of the right front side piece is connected to a right edge of the back piece;

a left front side piece having a top edge that forms a top terminal edge of the left front side piece and a bottom edge that forms a bottom terminal edge of the left front side piece, the left front side piece being configured to extend from slightly below a breastbone to over the temple of the wearer when worn in a fully extended position and having left and right edges, wherein the right edge of the left front side piece is connected to a left edge of the back piece, and the right front side piece is seamlessly connected to the back piece and the back piece is seamlessly connected to the left front side piece, and wherein the top edges of the right front side piece, the left front side piece and the back piece together form a top terminal edge of the garment;

a drawstring extending through a casing from a right edge of the right front side piece, across a middle portion of the back piece to the left edge of the left front side piece, the drawstring and the casing located midway between the top edges and the bottom edges of the right front side piece, the back piece and the left front side piece; and optionally, a lining;

wherein a first one of said front side pieces has a protrusion extending outwardly from an upper portion of the left edge of said first one of said front side pieces, said protrusion located below the top edge of the garment and only above the drawstring, said protrusion covering a continuously variable fastener, wherein when the garment is worn, the fastener fastens said first one of the front side pieces to a second one of the front side pieces by substantially overlapping the second one of the front side pieces, such that the face of the wearer is covered; and both of said front side pieces have high temple covering members extending up from an upper portion of the front side pieces adjacent to the attached back piece, configured to cover the temples of the wearer, and wherein the garment is constructed to form a substantially cylindrical opening at the top of the garment when the garment is in the closed position such that when the stand-alone garment is worn the first front side piece and the second front side piece overlap to cover the face of the wearer, and wherein the protrusion is adjacent to the substantially cylindrical opening.

2. An adjustable winter garment according to claim 1, wherein said garment includes the lining.

3. An adjustable winter garment according to claim 1, wherein said left front side piece and said right front side piece each have a wide shoulder member flaring to the side from the center of the garment and suitable for holding the garment over the shoulders.

4. An adjustable winter garment according to claim 1, wherein said left front side piece and said right front side piece are provided with continuously variable fasteners.

5. An adjustable winter garment according to claim 4, wherein said continuously variable fasteners are hook and loop tape.

6. An adjustable winter garment according to claim 1, wherein said garment is between approximately 33 inches to approximately 17 inches wide and between approximately 18 inches to approximately 12 inches long.

7. An adjustable winter garment according to claim 1, wherein said garment does not include the lining.

* * * * *